US008322322B2

(12) United States Patent
Saito

(10) Patent No.: US 8,322,322 B2
(45) **Date of Patent: *Dec. 4, 2012**

(54) DILUTING FUEL-IN-OIL TREATING APPARATUS OF INTERNAL COMBUSTION ENGINE

(75) Inventor: Yasuhiro Saito, Tokoname (JP)

(73) Assignee: Toyota Boshoku Kabushiki Kaisha, Kariya-Shi (JP)

( * ) Notice: Subject to any disclaimer, the term of this patent is extended or adjusted under 35 U.S.C. 154(b) by 881 days.

This patent is subject to a terminal disclaimer.

(21) Appl. No.: 12/414,026

(22) Filed: Mar. 30, 2009

(65) Prior Publication Data

US 2009/0255505 A1 Oct. 15, 2009

(30) Foreign Application Priority Data

Apr. 14, 2008 (JP) ..... 2008-105075

(51) Int. Cl.
*F01M 11/03* (2006.01)

(52) U.S. Cl. ..... 123/196 A; 210/416.5

(58) Field of Classification Search ..... 123/196 R, 123/196 A, 196 S, 198 R, 198 D; 210/167.04, 210/416.4, 416.5
See application file for complete search history.

(56) References Cited

U.S. PATENT DOCUMENTS 1,431,346 A * 10/1922 Watson ..... 123/196 A

FOREIGN PATENT DOCUMENTS

| | | |
|---|---|---|
| JP | 57-181914 | 11/1982 |
| JP | 1-143606 | 6/1989 |
| JP | 3-290012 | 12/1991 |
| JP | 2002-266619 | 9/2002 |
| JP | 2004-190513 A | 7/2004 |
| JP | 2004-340056 A | 12/2004 |
| JP | 2005-315172 A | 11/2005 |

OTHER PUBLICATIONS

English language Abstract and translation of JP 2004-190513 A (Jul. 8, 2004).
English language Abstract and translation of JP 2004-340056 A (Dec. 2, 2004).
English language Abstract and translation of JP 2005-315172 A (Nov. 10, 2005).
Japan Office action, dated Jan. 31, 2012 along with an English translation thereof.

* cited by examiner

*Primary Examiner* — Noah Kamen
(74) *Attorney, Agent, or Firm* — Greenblum & Bernstein, P.L.C.

(57) ABSTRACT

The present apparatus includes an oil container (an oil pan); an oil path connecting the oil container to lubricated parts; an oil pump provided in the oil path and supplying the lubricating oil from the oil container to the lubricated parts; a bypass path having a first end side thereof connected to a downstream side of the oil pump of the oil path and a second end side thereof connected to an upstream side of the oil pump of the oil path; a fuel separator provided in the bypass path and separating fuel from the lubricating oil flowing in the bypass path; and an open/close valve provided in the bypass path and opening and closing the bypass path based on a temperature of the lubricating oil or a physical quantity the lubricating oil having a correlation with the temperature.

7 Claims, 4 Drawing Sheets

DILUTING FUEL-IN-OIL TREATING APPARATUS OF INTERNAL COMBUSTION ENGINE

CROSS-REFERENCE TO RELATED APPLICATIONS

The present application claims priority under 35 U.S.C. §119 of Japanese Patent Application No. 2008-105075, filed on Apr. 14, 2008, the disclosure of which is expressly incorporated by reference herein in its entirety.

BACKGROUND OF THE INVENTION

1. Field of the Invention

The present invention relates to diluting fuel-in-oil treating apparatuses of internal combustion engines and, more particularly, the present invention relates to a diluting fuel-in-oil treating apparatus of an internal combustion engine that can separate the fuel from the lubricating oil of the internal combustion engine while suppressing degradation of the oil, and that enables stable control of an air-fuel ratio at an air intake side.

2. Description of Related Art

Known conventional diluting fuel-in-oil treating apparatuses of internal combustion engines heat lubricating oil and separate the fuel from the lubricating oil by vaporization in order to suppress dilution of the lubricating oil which is caused by the mixed-in fuel (e.g., Related Arts 1 and 2). Related Art 1 discloses such technology in which an oil heater is provided on an oil circuit of the internal combustion engine for heating the lubricating oil flowing in the oil circuit in order to separate the fuel by vaporization. Related Art 2 also discloses such technology in which a heater is provided at a bottom portion of an oil pan for heating the lubricating oil in the oil pan in order to separate the fuel by vaporization.

[Related Art 1] Japanese Laid-open Patent Publication No. 2004-190513

[Related Art 2] Japanese Laid-open Patent Publication No. 2004-340056

In the technologies disclosed in Related Arts 1 and 2, the fuel in the lubricating oil is vaporized using a heater. Since some fuels have a higher boiling point (e.g., 200° C. and the like) depending on the component thereof, heating lubricating oil up to approximately 130° C., which is the maximum temperature at normal use conditions, leaves equal to or more than 30% of the fuel component in the lubricating oil unvaporized. On the other hand, although heating lubricating oil up to approximately 200° C. allows substantially all the fuel in the lubricating oil to vaporize, degradation of the oil is accelerated. In addition, since rapid vaporization of the fuel causes a large amount of the fuel component to be reduced to blow-by gas, stable control of an air-fuel ratio is difficult to achieve at the air intake side. Particularly, the above-described problem is conspicuous with the technology disclosed in Related Art 1 since the heater is used to heat a relatively large amount of the lubricating oil flowing in the oil path that connects the oil pan to lubricated parts in the engine or in a bypass path provided in the oil path. In addition, the above-described problem is extremely conspicuous with the technology disclosed in Related Art 2 since all the oil in the oil pan is heated.

SUMMARY OF THE INVENTION

The present invention is provided to resolve the above-described problems. A purpose of the present invention is to provide a diluting fuel-in-oil treating apparatus of an internal combustion engine that can separate the fuel from the lubricating oil of the internal combustion engine while suppressing degradation of the oil, and that enables more stable control of an air-fuel ratio at the air intake side.

The present invention is described hereinafter.

1. A diluting fuel-in-oil treating apparatus of an internal combustion engine includes an oil container configured to contain lubricating oil of the internal combustion engine; an oil path configured to connect the oil container to lubricated parts of the internal combustion engine; an oil pump provided in the oil path and configured to supply the lubricating oil from the oil container to the lubricated parts of the internal combustion engine; a bypass path having a first end connected to a downstream side of the oil pump of the oil path and a second end connected to an upstream side of the oil pump; a fuel separator provided in the bypass path and configured to separate fuel from the lubricating oil flowing in the bypass path; and an open/close valve provided in the bypass path and configured to open and close the bypass path based on one of a temperature of the lubricating oil and a physical quantity of the lubricating oil having a correlation with the temperature.

2. According to the diluting fuel-in-oil treating apparatus of the internal combustion engine described in 1 above, the fuel separator is a cross-flow filtration fuel separator having a separation membrane configured to separate by permeation the fuel from the lubricating oil flowing in the bypass path.

3. According to the diluting fuel-in-oil treating apparatus of the internal combustion engine described in 1 above, the second end of the bypass path is connected to the oil container.

4. According to the diluting fuel-in-oil treating apparatus of the internal combustion engine described in 2 above, the cross-flow filtration fuel separator includes a separator main body having a generally tubular shape and a separation member having the separation membrane. The separation member is provided inside the separator main body and partitions the interior of the separator main body into a first region and a second region. The separator main body includes an oil inlet configured to introduce lubricating oil in the first region, an oil discharger configured to discharge the lubricating oil from the first region, and a fuel discharger configured to discharge the fuel from the second region.

5. According to the diluting fuel-in-oil treating apparatus of the internal combustion engine described in 4 above, the separation member is generally tubular and has an axis extending along a direction of an axis of the separator main body.

6. According to the diluting fuel-in-oil treating apparatus of the internal combustion engine described in 5 above, the oil inlet is configured to introduce the lubricating oil in a direction tangential to the separator main body.

7. According to the diluting fuel-in-oil treating apparatus of the internal combustion engine described in 4 above, the separation member includes the separation membrane having a tubular shape and a plurality of fuel-component permeable fine pores and a support body configured to support the separation membrane and including a plurality of fine pores. The diameters of the plurality of fine pores of the support body are larger than the plurality of fuel-component permeable fine pores of the separation membrane.

According to the diluting fuel-in-oil treating apparatus of the internal combustion engine of the present invention, the open/close valve opens the bypass path when the temperature of the lubricating oil is low, so that a portion of the lubricating oil flowing in the oil path by the action of the oil pump flows into the bypass path. Then, the fuel in the lubricating oil is separated by the fuel separator. Meanwhile, the open/close valve closes the bypass path when the temperature of the lubricating oil is high, so that all the lubricating oil flowing in the oil path by the action of the oil pump is supplied to the lubricated parts in the internal combustion engine. As described above, when the degree of fuel dilution of the lubricating oil is relatively high at a low temperature, the fuel is separated from a relatively small amount of the lubricating oil branching from the oil path and flowing into the bypass path. Thereby, the fuel can be separated while suppressing degradation of the oil. In addition, since reduction of a large amount of the fuel component to blow-by gas is prevented, more stable control of an air-fuel ratio is enabled at the air intake side. Furthermore, when the degree of fuel dilution of the lubricating oil is relatively low at a high temperature, the lubricating oil flows only in the oil path and does not branch into the bypass path. Thereby, an oil pressure necessary for facilitating the flow of the lubricating oil can be maintained. When the fuel separator is a cross-flow filtration separator having a separation membrane separating the fuel from the lubricating oil by permeation, the lubricating oil does not have to be heated at a high temperature. Thereby, the fuel can be separated while securely suppressing degradation of the oil. In addition, since the cross-flow filtration prevents accumulation of foreign objects such as sludge in the lubricating oil on the surface of the separation membrane, the separation efficiency of the separation membrane can be prevented from deteriorating. When the bypass path has the second end side thereof connected to the upstream side of the oil pump of the oil path, at a low lubricating oil temperature, the lubricating oil flowing in the bypass path at a certain speed after the fuel is separated therefrom is returned to the upstream side of the oil pump of the oil path. Thereby, friction in the internal combustion engine can be reduced. When the bypass path has the second end side thereof connected to the oil container, at a low lubricating oil temperature, the lubricating oil is returned to the oil container after the fuel was separated therefrom and is mixed into a large amount of the lubricating oil in the oil container from which the fuel has not yet been separated. Thereby, lubricating oil including a relatively large amount of fuel component flows in the oil path, thereby improving the fuel separation efficiency.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE INVENTION

Figure 1:
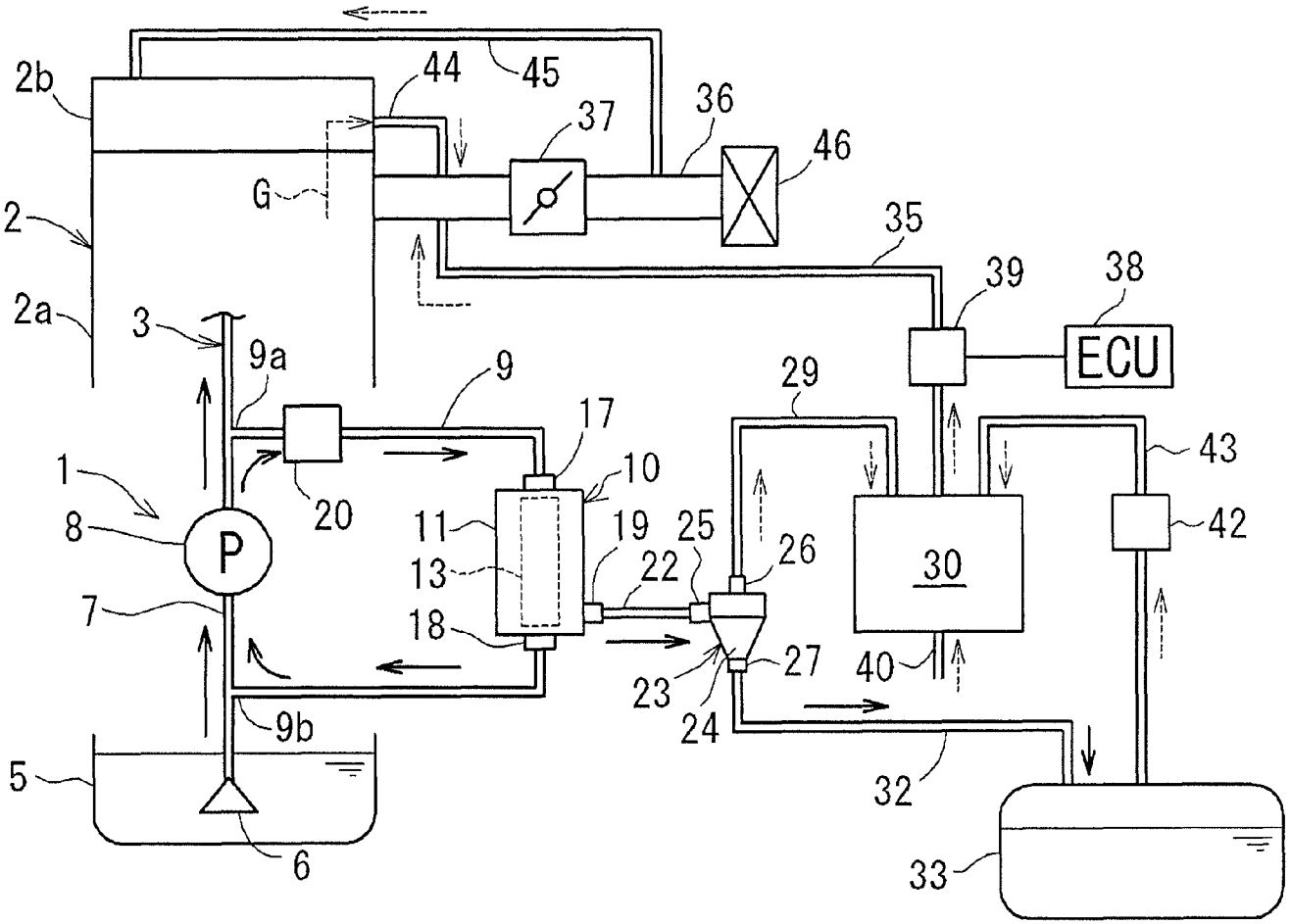
FIG. 1 is an overall circuit diagram schematically illustrating a diluting fuel-in-oil treating apparatus according to an embodiment.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description is taken with the drawings making apparent to those skilled in the art how the forms of the present invention may be embodied in practice.

1. A Diluting Fuel-in-Oil Treating Apparatus of an Internal Combustion Engine

The present embodiment 1 provides a diluting fuel-in-oil treating apparatus of an internal combustion engine including an oil container, an oil path, an oil pump, a bypass path, a fuel separator, and an open/close valve.

As long as the "oil container" contains lubricating oil of the internal combustion engine, the structure, the shape, the material, and the like thereof are not particularly specified. Examples of the oil container includes an oil pan that is provided at the lower portion of the main body of the internal combustion engine, an oil tank that is provided separately from the main body of the internal combustion engine, and the like.

As long as the "oil path" connects the oil container to lubricated parts of the internal combustion engine, the structure, the installation manner, and the like thereof are not particularly specified. Examples of the oil path include any combination of one or more of the following: a pipe, a path provided in the main body or the mechanism unit of the internal combustion engine, space, and the like. In addition, examples of the lubricated parts in the internal combustion engine include a bearing, a piston, a camshaft, a valve system, and the like.

As long as the "oil pump" is provided in the oil path and supplies the lubricating oil from the oil container to the lubricated parts of the internal combustion engine, the structure, the installation manner, and the like thereof are not particularly specified. Examples of the oil pump include a trochoid pump, an internal gear pump, an external gear pump, an inner gear pump, and the like. In addition, the oil pump may be operated, for example, by a driving force of the internal combustion engine or by a drive source other than the internal combustion engine.

As long as the "bypass path" has a first end side (an inlet end side) thereof connected to a downstream side of the oil pump of the oil path and a second end side (an outlet end side) thereof connected to an upstream side of the oil pump, the structure, the installation manner, and the like thereof are not particularly specified. Examples of the bypass path include any combination of one or more of the following: a pipe, a path provided in the main body or the mechanism unit of the internal combustion engine, space, and the like. Examples of the connection configuration of the second end side of the bypass path include: (1) a configuration in which the second end side of the bypass path is connected to the upstream side of the oil pump of the oil path (Refer to FIG. 1); (2) a configuration in which the second end side of the bypass path is connected to the oil container (Refer to FIG. 8); and the like.

As long as the "fuel separator" is provided in the bypass path and separates the fuel from the lubricating oil flowing in the bypass path, the structure, the separation method, and the like thereof are not particularly specified. This fuel separator may be, for example, a heater or the like that heats the lubricating oil flowing in the bypass path in order to separate the fuel by vaporization. It is preferable, however, that the fuel separator is a cross-flow filtration separator having a separation membrane configured to separate by permeation, the fuel from the lubricating oil flowing in the bypass path. The "cross-flow filtration" means filtration in which a portion of a flow passes through a filter medium.

The fuel separator may include, for example, a metal or resin separator main body having a tubular shape and a separation member having the separation membrane. The separation member is provided inside the separator main body and partitions the interior of the separator main body into a first region and a second region. The separator main body includes an oil inlet introducing oil in the first region, an oil discharger configured to discharge the oil from the first region, and a fuel discharger configured to discharge the fuel component from the second region. This configuration allows the fuel separator to have a simplified and compact structure. With this fuel separator, oil is introduced from the oil inlet into the first region of the separator main body, and a fuel component is separated by permeation through the separation membrane while the oil flows in the first region. Then, the oil is discharged from the first region to the outside of the separator main body through the oil discharger. Meanwhile, the fuel component separated from the oil by permeation through the separation membrane flows in the second region and is discharged from the second region to the outside of the separator main body through the fuel discharger.

In the above-described configuration, for example, the separation member may have a tubular or columnar shape having an axis provided along the direction of the axis of the separator main body having a tubular shape. This configuration allows the fuel separator to have a more simplified and smaller-sized structure. In this case, examples of the partition configuration into the first region, the second region, and the like may include: (1) a configuration in which the first region is the inside region of the separation member, and the second region is the outside region of the separation member (Refer to FIG. 2); (2) a configuration in which the first region is the outside region of the separation member, and the second region is the inside region of the separation member (Refer to FIG. 4); and the like. The configuration (2) allows the first region in which a relatively large amount of oil flows to have a large capacity.

In the configuration (1), for example, the fuel discharger may be provided to discharge the fuel in the direction tangential to the separator main body. This configuration adds a turning force to the fuel in the second region, and the turn makes the pressure at the axis side smaller than that of the centrifugal side in the second region. Consequently, the pressure difference between the first region and the second region can be increased, thereby enhancing permeability of the fuel through the separation membrane.

In the configuration (2), for example, the oil inlet may be provided to introduce oil in the direction tangential to the separator main body. This configuration adds a turning force to the fuel in the first region, and the turn causes foreign objects such as metal powder having a large relative density in the oil to be deposited in the centrifugal direction of the separator main body. Consequently, accumulation of foreign objects on the surface of the separation membrane is further prevented. In this case, it is preferable that the oil discharger is provided to discharge the oil in the direction tangential to the separator main body, so that the oil in the first region is provided with a stronger turning force. In the configuration (2), for example, a collector may be provided at the inner peripheral surface side of the separator main body, the collector configured to collect foreign objects such as metal powder having a large relative density in the oil. This configuration prevents entry of foreign objects in the fuel after separation.

The separation member may include, for example, the separation membrane and a support body. The separation membrane is provided with a large number of fuel-component permeable fine pores and has a tubular shape. The support body is provided with a large number of fine pores having larger diameters than those of the fine pores of the separation membrane and supports the separation membrane. Examples of configurations of the separation member include: (a) a configuration in which the separation membrane having a tubular shape is supported at the inner peripheral side of the support body having a tubular shape (Refer to FIG. 3); (b) a configuration in which the separation membrane having a tubular shape is supported at the outer peripheral side of the support body having a tubular shape (Refer to FIG. 5); (c) a configuration in which the support body having a columnar shape is provided with a plurality of through holes, in each of which a separation membrane is supported (Refer to FIG. 7); and the like. The shape, the material, the number of pieces, and the like of the separation member, the support body, and the separation membrane are selected properly according to the flow rate and the like of the oil to be separated. The thickness of the separation membrane may be, for example, 1-1000 μm (preferably, 10-20 μm). Examples of the material of the separation member, the support body, and the separation membrane include ceramic, resin, rubber, and the like.

The fuel separator may further include, for example, a heater heating the separation member (e.g., a heater or the like provided on the surface side of or inside the separation member). Thereby, separation of fuel component from oil can be further accelerated.

As long as the "open/close valve" is provided in the bypass path and opens and closes the bypass path based on the temperature of the lubricating oil or the physical quantity that has a correlation with the temperature, the structure, the opening and closing manner, and the like thereof are not particularly specified. Examples of the physical quantity include the pressure, the viscosity, and the fuel dilution of the lubricating oil, the temperature of the cooling water that cools the lubricating oil, the temperature of the components of the internal combustion engine, and the like. According to the present embodiment, for example, the pressure of the lubricating oil flowing in the oil path is approximately 400 kPa when the temperature thereof is approximately 50° C., and the pressure thereof is approximately 200 kPa when the temperature thereof is approximately 130° C. In short, the pressure of the lubricating oil has a constant correlation with the temperature thereof of the lubricating oil. The open/close valve may be provided, for example, on the downstream side of the fuel separator of the bypass path. However, it is preferable that the open/close valve is provided on the upstream side of the fuel separator of the bypass path. The reason for this is to minimize or substantially eliminate residual oil in the bypass path in its closed state so that the necessary amount of lubricating oil is easily ensured. Examples of the open/close valve include: (1) a valve body that is urged by an elastic body such as a spring and the like to the position for closing the bypass path and that is displaced to open the bypass path by the pressure of the lubricating oil flowing into the bypass path when the pressure of the lubricating oil exceeds a predetermined setting value (e.g., any numerical value from 375 to 425 kPa); (2) a thermostat that closes the bypass path when the temperature of the lubricating oil flowing into the bypass path exceeds a predetermined setting value (e.g., any numerical value from 40° C. to 60° C.) and opens the bypass path when the temperature is equal to or lower than the predetermined setting value; (3) a solenoid valve that is controlled to open and close based on the detection result of a detection sensor that detects the temperature of the lubricating oil; and (4) a solenoid valve that is controlled to open and close based on the detection result of a detection sensor that detects the physical quantity. In terms of simplified configuration, the example (1) is preferable. In addition, in terms of control by more accurate temperature, the examples (2) and (3) are preferable.

In the present embodiment, as described above, when the fuel separator is a cross-flow filtration separator, the diluting fuel-in-oil treating apparatus may further include a vapor-liquid separator and a fuel collector. The vapor-liquid separator separates the fuel separated by the fuel separator into a gas component and a liquid component. The fuel collector collects the gas component of the fuel separated by the vapor-liquid separator. In this configuration, the fuel separated by permeation by the fuel separator is separated by the vapor-liquid separator into the gas component and the liquid component, and the gas component of the fuel after vapor-liquid separation is temporarily collected by the fuel collector. Subsequently, the gas component is returned to the air intake side at a proper timing. Thereby, stable control of an air-fuel ratio is enabled at the air intake side. Examples of the vapor-liquid separator include a centrifugal type, a chamber type, and the like. Examples of the fuel collector include a canister having an adsorbent such as granular activated carbon filled therein, a canister configured with an adsorbent honeycomb structure such as activated carbon, and the like. In the configuration described above, the diluting fuel-in-oil treating apparatus may further include, for example, a fuel return path connecting a liquid component discharger of the vapor-liquid separator and a fuel tank of the internal combustion engine. This configuration improves the fuel economy since the liquid component of the fuel after vapor-liquid separation by the vapor-liquid separator is returned to the fuel tank via the fuel return path.

EMBODIMENT

The embodiment of the present invention will be described in detail with reference to the drawings. In the embodiment, a direct fuel-injection engine is mentioned as an example of an "internal combustion engine" according to the present invention, the direct fuel-injection engine being provided with a fuel injection valve in a combustion chamber thereof and directly injecting fuel onto an inner peripheral surface of a cylinder.

(1) A Configuration of a Diluting Fuel-in-Oil Treating Apparatus

A diluting fuel-in-oil treating apparatus 1 according to the embodiment is provided midway through an oil circuit 3 of an engine 2 as shown FIG. 1. The engine 2 is provided with an oil pan 5 (mentioned as an example of an "oil container" according to the present invention) at a lower portion of a main body 2*a* thereof in order to contain lubricating oil. The oil pan 5 is provided with a known oil strainer 6 therein. The oil strainer 6 and the lubricated parts of the engine 2 (omitted in the drawings) are connected via an oil path 7 that configures the oil circuit 3. An oil pump 8 is provided midway through the oil path 7 for pressure-feeding the lubricating oil from the oil pan 5 to each of the lubricated parts by the driving force of the engine 2.

A bypass path 9 has a first end side 9*a* (an inlet end side) thereof connected to a downstream side of the oil pump 8 of the oil path 7. In addition, the bypass path 9 has a second end side 9*b* (an outlet end side) thereof connected to an upstream side of the oil pump 8 of the oil path 7. A fuel separator 10 (mentioned as an example of a "fuel separator" according to the present invention) is provided midway through the bypass path 9, the fuel separator 10 separating the fuel from the lubricating oil flowing in the bypass path 9.

Figure 2:
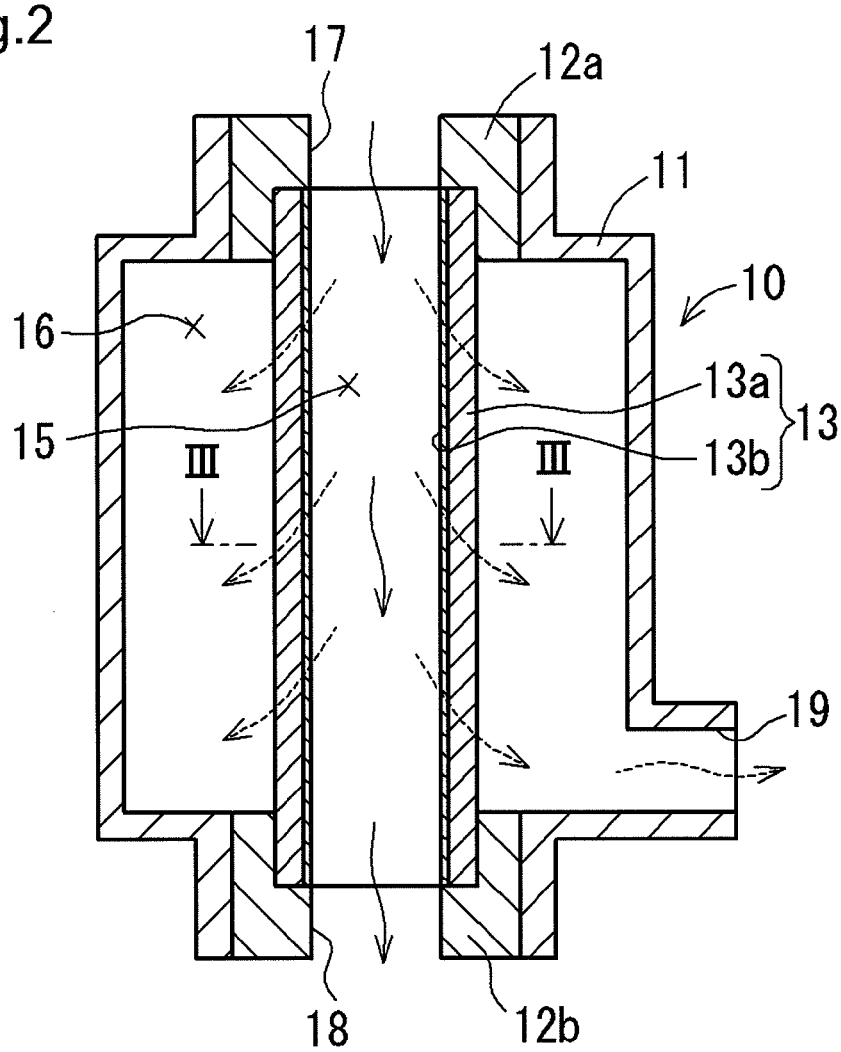
FIG. 2 is a longitudinal sectional view of a fuel separator according to the embodiment.

As shown in FIG. 2, the fuel separator 10 is provided with a metal separator main body 11 having a tubular shape. The separator main body 11 is provided with ring members 12*a* and 12*b* at both axial end sides thereof, the ring members 12*a* and 12*b* having a stepped opening. A ceramic filter 13 (mentioned as an example of a "separation member" according to the present invention) having a cylindrical shape is supported at both end sides thereof by each of the ring members 12*a* and 12*b*. The ceramic filter 13 is provided inside the separator main body 11 along an axis of the separator main body 11. The ceramic filter 13 partitions the interior of the separator main body 11 into a first region 15 that is an inner side of the ceramic filter 13 and a second region 16 that is an external side of the ceramic filter 13. An oil inlet 17 that introduces lubricating oil from the outside into the first region 15 is configured by the inner peripheral side of the ring members 12*a* at one side. An oil discharger 18 that discharges lubricating oil from the first region 15 to the outside is configured by the inner peripheral side of the ring member 12*b* at the other side. A fuel discharger 19 is provided at an outer peripheral side of the separator main body 11 to discharge a fuel component to the outside, the fuel component flowing in the second region 16 after separation by permeation through the ceramic filter 13.

Figure 3:
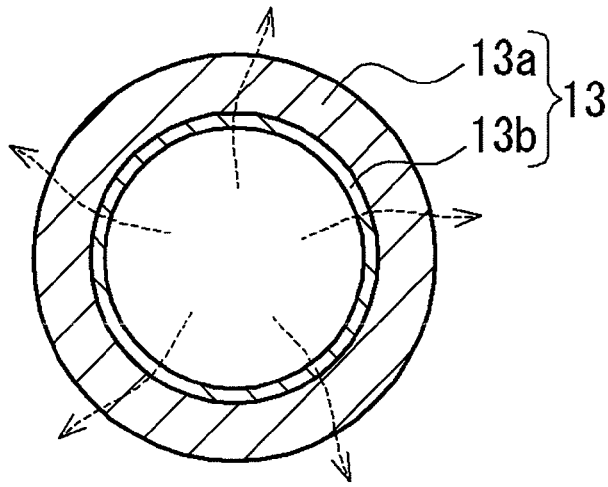
FIG. 3 is a cross-sectional view of the fuel separator taken along a line III-III in FIG. 2.

As shown in FIG. 3, the ceramic filter 13 is two-layered, having a support body 13*a* and a separation membrane 13*b*. The support body 13*a* having a tubular shape is provided with a large number of fine pores. The separation membrane 13*b* having a cylindrical shape is supported by an inner peripheral surface of the support body 13*a* and is provided with a large number of fuel-component permeable fine pores. The thickness of the support body 13*a* is approximately 2 mm, and the thickness of the separation membrane 13*b* is approximately 10 μm. The average pore diameter of the support body 13*a* is approximately 10 μm, and the average pore diameter of the separation membrane 13*b* is approximately 20 nm.

Fuel used in an engine, such as gasoline, has a molecular structure having approximately 4 to 13 carbon atoms for each molecule. Oil has a molecular structure having equal to or more than 25 carbon atoms for each molecule. Due to such difference in the molecular structures, the diameter of the fuel molecule is smaller than that of the fine pores of the separation membrane 13*b*, and the diameter of the oil molecule is larger than that of the fine pores of the separation membrane 13*b*. Thereby, the fuel mixed in the oil can be separated by the ceramic filter 13. In addition, since the pore diameter of the support body 13*a* is extremely large when compared to that of the separation membrane 13*b*, the fuel that has passed through the separation membrane 13*b* can pass through the support body 13*a* with smaller resistance than that of passing through the separation membrane 13*b*.

As shown in FIG. 1, a known open/close valve 20 is provided on the upstream side of the fuel separator 10 of the bypass path 9, the open/close valve 20 opening and closing the bypass path 9 according to the pressure of the lubricating oil (mentioned as an example of a "physical quantity having a correlation with a temperature" according to the present invention) flowing in the bypass path 9. The open/close valve 20 is provided with a valve body (omitted in the drawing) that is urged by an elastic body such as a spring (omitted in the drawing) to a position for closing the bypass path 9. The valve body is displaced to open the bypass path 9 by the pressure of the lubricating oil flowing into the bypass path 9 when the pressure of the lubricating oil exceeds a predetermined setting value (e.g., 400 kPa). A portion of the lubricating oil flowing in the oil path 7 by the action of the oil pump 8 flows in the bypass path 9 that is opened by the open/close valve 20.

The fuel discharger 19 of the fuel separator 10 is connected to a known centrifugal vapor-liquid separator 23 via a path 22. The vapor-liquid separator 23 is provided with a main body 24 having a substantially cylindrical shape. The main body 24 is provided on a wall of the upper side thereof with a fuel inlet 25 to which an end side of the path 22 is connected. The fuel inlet 25 introduces the fuel that is discharged from the fuel discharger 19 of the fuel separator 10 into the main body 24 in the tangential direction. The main body 24 is provided with a gas-component discharger 26 on a ceiling wall thereof, the gas-component discharger 26 discharging to the outside, the gas component of the fuel centrifugally separated in the main body 24. The main body 24 is provided with a liquid-component discharger 27 at the lower portion thereof, the liquid-component discharger 27 discharging a liquid component of the fuel centrifugally separated in the main body 24.

The gas-component discharger 26 of the vapor-liquid separator 23 is connected to a canister 30 via a path 29, the canister having a granular activated carbon filled therein. The gas component centrifugally separated by the vapor-liquid separator 23 is adsorbed in the canister 30 via the path 29 and is temporarily collected. The liquid-component discharger 27 of the vapor-liquid separator 23 is connected to a fuel tank 33 via a fuel return path 32. The liquid component of the fuel centrifugally separated by the vapor-liquid separator 23 is returned to the fuel tank 33 via the fuel return path 32.

The canister 30 is connected to the downstream side of a throttle valve 37 of an air intake pipe 36 via a path 35. A purge solenoid valve 39 that is controlled by an engine control unit 38 (ECU) to open and close the path 35 is provided midway through the path 35. When the solenoid valve 39 opens the path 35, air is introduced from a path 40. Thereby, the gas component of the fuel temporarily collected in the canister 30 is introduced into the air intake pipe 36 and is burned. The fuel tank 33 is connected to the canister 30 via a path 43 midway through which a known non-return valve 42 is provided. The gas component of the fuel produced in the fuel tank 33 is adsorbed in the canister 30 via the path 43 and is temporarily collected.

The engine control unit 38 controls the purge solenoid valve 39, the ignition timing of an ignition plug, the amount of the fuel injected from a fuel injection valve, the injection timing, and the like based on the input from various sensors. The downstream side of the throttle valve 37 of the air intake pipe 36 is connected to the interior of a head cover 2*b* via a path 44. A blow-by gas G (shown by the arrow with a dotted line in FIG. 1) produced in the engine main body 2*a* is refluxed to the air intake pipe 36 via the path 44. The upstream side of the throttle valve 37 of the air intake pipe 36 is connected to the interior of the head cover 2*b* via a path 45 via which fresh air is introduced into the head cover 2*b*. In addition, an air cleaner 46 is provided on the upstream side of the throttle valve 37 of the air intake pipe 36.

(2) A Function of a Diluting Fuel-in-Oil Treating Apparatus

Hereinafter, the function of the diluting fuel-in-oil treating apparatus 1 having the above configuration will be described. In the present embodiment, since the direct fuel-injection engine 2 is employed, the fuel that attaches to the inner peripheral surface of the cylinder is mixed into the lubricating oil. Therefore, the lubricating oil in the oil pan 5 is easily diluted. Particularly, when the temperature of the lubricating oil is low (e.g., equal to or lower than 50° C.), there is little vaporization of the fuel in the lubricating oil and therefore the amount of the diluting fuel is relatively large. Meanwhile, when the temperature of the lubricating oil is high (e.g., 130° C.), most of the fuel in the lubricating oil is vaporized, and therefore the amount of the diluting fuel in the lubricating oil is relatively small.

When the temperature of the lubricating oil is low (e.g., equal to or lower than 50° C.), and the amount of the diluting fuel is relatively large, the open/close valve 20 opens the bypass path 9, as shown by the arrow with a solid line in FIG. 1, a large portion of the lubricating oil flowing in the oil path 7 by the action of the oil pump 8 is supplied to each of the lubricated parts in the engine 2. In addition, a portion of the lubricating oil flowing in the oil path 7 flows into the bypass path 9, and the fuel separator 10 separates the fuel in the lubricating oil. At this time, as shown by the arrow with a solid line in FIG. 2, the fuel component is separated from the lubricating oil introduced from the oil inlet 17 into the first region 15, by permeation through the ceramic filter 13, and the lubricating oil is discharged from the oil discharger 18 to the outside. Then, the discharged lubricating oil flows in the bypass path 9 and returns to the oil path 7. Meanwhile, as shown by the arrow with a dotted line in FIG. 2, the fuel separated from the lubricating oil by permeation through the ceramic filter 13 reaches the second region 16 and is discharged from the fuel discharger 19 to the outside of the separator main body 11. Then, the discharged fuel is introduced into the vapor-liquid separator 23 via the path 22 and is centrifugally separated into the gas component and the liquid component.

The gas component of the fuel centrifugally separated by the vapor-liquid separator 23 is adsorbed in the canister 30 via the path 29 and is temporarily collected. Then, the engine control unit 38 switches the purge solenoid valve 39 at a proper timing. The gas component of the fuel, which has been collected by the canister 30, is introduced to the air intake pipe 36 via the path 35 opened by the solenoid valve 39 and is burned. In addition, the liquid component of the fuel centrifugally separated by the vapor-liquid separator 23 is returned to the fuel tank 33 via the fuel return path 32.

Meanwhile, when the temperature of the lubricating oil is high (e.g., 130° C.) and the amount of the diluting fuel in the lubricating oil is relatively small, the open/close valve 20 closes the bypass path 9, and all of the lubricating oil flowing in the oil path 7 by the action of the oil pump 8 is supplied to each of the lubricated parts in the engine 2. In addition, a large portion of the fuel component in the lubricating oil in the oil pan 5 is vaporized and is mixed into the blow-by gas G produced in the engine main body 2*a*. The mixed gas is refluxed to the air intake pipe 36 via the path 44.

(3) An Effect of the Embodiment

In the present embodiment, the open/close valve 20 opens the bypass path 9 when the temperature of the lubricating oil is low (i.e., when the pressure of the lubricating oil is high) so that a portion of the lubricating oil flowing in the oil path 7 by the action of the oil pump 8 flows into the bypass path 9. Then, the fuel in the lubricating oil is separated by the fuel separator 10. Meanwhile, the open/close valve 20 closes the bypass path 9 when the oil temperature is high (i.e., when the pressure of the lubricating oil is low) so that all the lubricating oil flowing in the oil path 7 by the action of the oil pump 8 is supplied to each of the lubricated parts in the engine 2. As described above, when the degree of fuel dilution of the lubricating oil is relatively high at a low temperature, the fuel is separated from a relatively small amount of the lubricating oil branching from the oil path 7 and flowing in the bypass path 9. Thereby, the fuel can be separated while suppressing degradation of the oil. In addition, since reduction of a large amount of the fuel component to blow-by gas is prevented, more stable control of an air-fuel ratio can be enabled at the air intake side. Furthermore, since the lubricating oil does not separately flow into the bypass path 9 and flows only in the oil path 7 when the degree of fuel dilution of the lubricating oil is relatively law at a high temperature, an oil pressure necessary for facilitating the flow of the lubricating oil can be maintained.

In the present embodiment, the fuel separator 10 that is a cross-flow filtration separator and that has the separation membrane 13*b* separating by permeation, the fuel from the lubricating oil flowing in the bypass path 9 is employed. Therefore, the lubricating oil does not have to be heated at a high temperature, and the fuel can be separated while securely suppressing degradation of the oil. In addition, since the cross-flow filtration prevents accumulation of foreign objects such as sludge in the lubricating oil on the surface of the separation membrane 13*b*, the separation efficiency of the separation membrane 13*b* can be prevented from deteriorating.

In the present embodiment, the bypass path 9 has the second end side (the outlet end side) thereof connected to the upstream side of the oil pump 8 of the oil path 7 so that, when the temperature of the lubricating oil is low, the lubricating oil flowing in the bypass path 9 at a certain speed after the fuel is separated therefrom is returned to the upstream side of the oil pump 8 of the oil path 7. Thereby, friction in the engine 2 can be reduced.

In the present embodiment, the open/close valve 20 is provided on the upstream side of the fuel separator 10 of the bypass path 9. Thereby, the residual oil in the bypass path 9 in its closed state can be minimized or substantially eliminated, allowing the amount of the lubricating oil necessary at a high temperature to be more easily ensured.

The present invention is not limited to the present embodiment and includes other embodiments with various modifications within the scope of the present invention according to the purpose and use thereof. In other words, although the fuel separator 10 having the separation membrane 13*b* that separates the fuel from the lubricating by permeation is mentioned as an example in the present embodiment, the present invention is not limited to the same, and, for example, a heater that heats lubricating oil for separation by vaporization may be used as a fuel separator.

Although the open/close valve 20 that opens and closes based on the pressure of the lubricating oil is mentioned as an example in the present embodiment, the present invention is not limited to the same, and, for example, a thermostat valve that opens and closes based on the temperature of the lubricating oil may be employed. In addition, a solenoid valve may be employed, the solenoid valve being controlled to open and close based on the detection result of a detection sensor that detects any combination of one or more of: the temperature, the pressure, the viscosity, and the fuel dilution of the lubricating oil, the temperature of the cooling water that cools the lubricating oil, the temperature of the components of the internal combustion engine, and the like.

Figure 8:
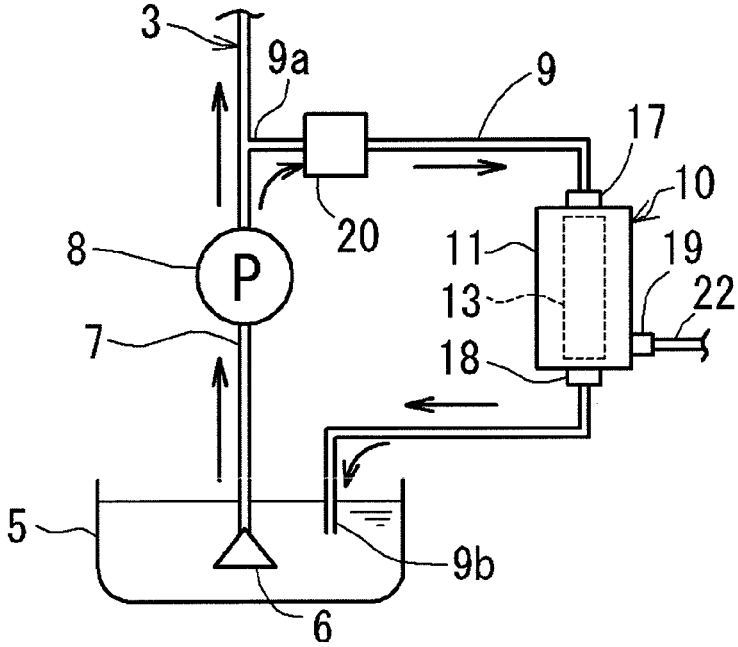
FIG. 8 is a partial circuit diagram schematically illustrating a diluting fuel-in-oil treating apparatus according to an alternative embodiment.

Although the bypass path 9 has the second end side 9*b* (the outlet end side) thereof connected to the upstream side of the oil pump 8 of the oil path 7 in the present embodiment, the present invention is not limited to the same, and, as shown in FIG. 8, the second end side 9*b* (the outlet end side) of the bypass path 9 may be connected into the oil pan 5, for example. In this case, the lubricating oil is returned to the oil pan 5 after the fuel was separated therefrom and is mixed into a large amount of the lubricating oil in the oil pan 5 from which the fuel has not yet been separated. Thereby, the lubricating oil including a relatively large amount of the fuel component flows in the oil path 7, improving the fuel separation efficiency.

Although the centrifugal vapor-liquid separator 23 is mentioned as an example in the present embodiment, the present invention is not limited to the same, and, for example, a chamber type vapor-liquid separator may be used, that has a main body including a separation chamber partitioned into a plurality of spaces by partition walls, and separates the fuel introduced into the separation chamber of the main body into the gas component and the liquid component by causing the fuel to collide with the partition walls and to flow.

Although the canister 30 having a granular activated carbon and the like filled therein is mentioned as an example of a fuel collector in the present embodiment, the present invention is not limited to the same, and, for example, a canister configured with an activated carbon honeycomb structure may be used.

Figure 4:
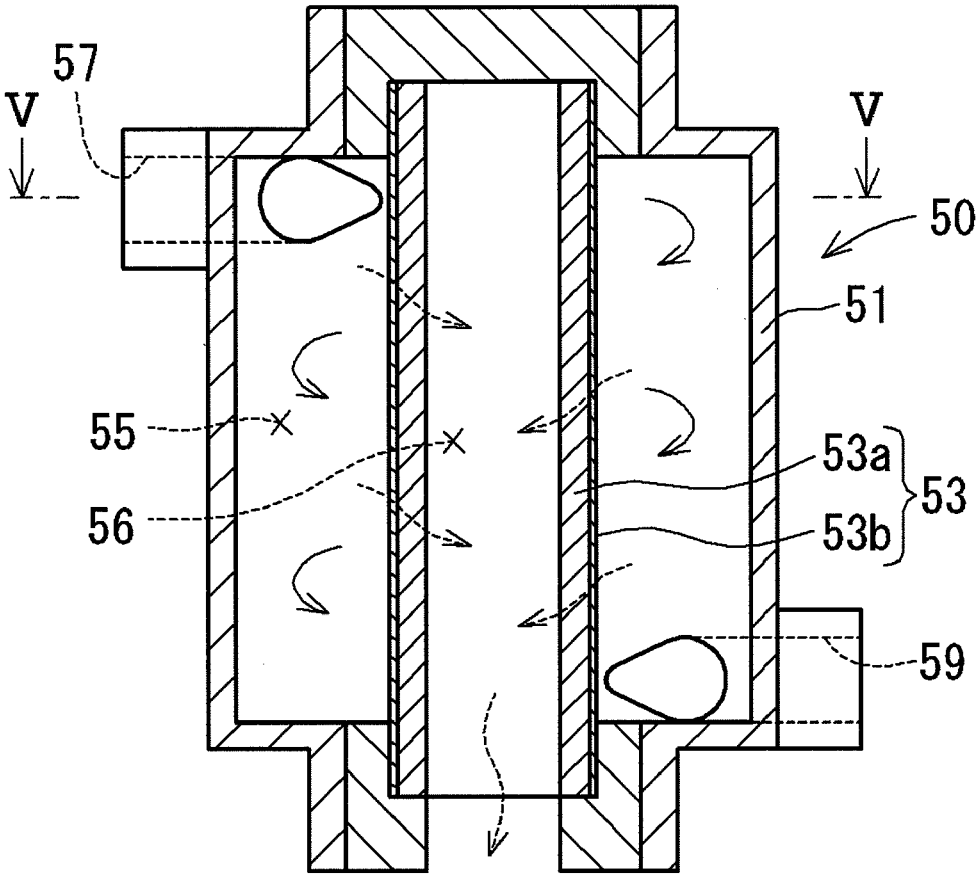
FIG. 4 is a longitudinal sectional view of a fuel separator according to an alternative embodiment.
Figure 5:
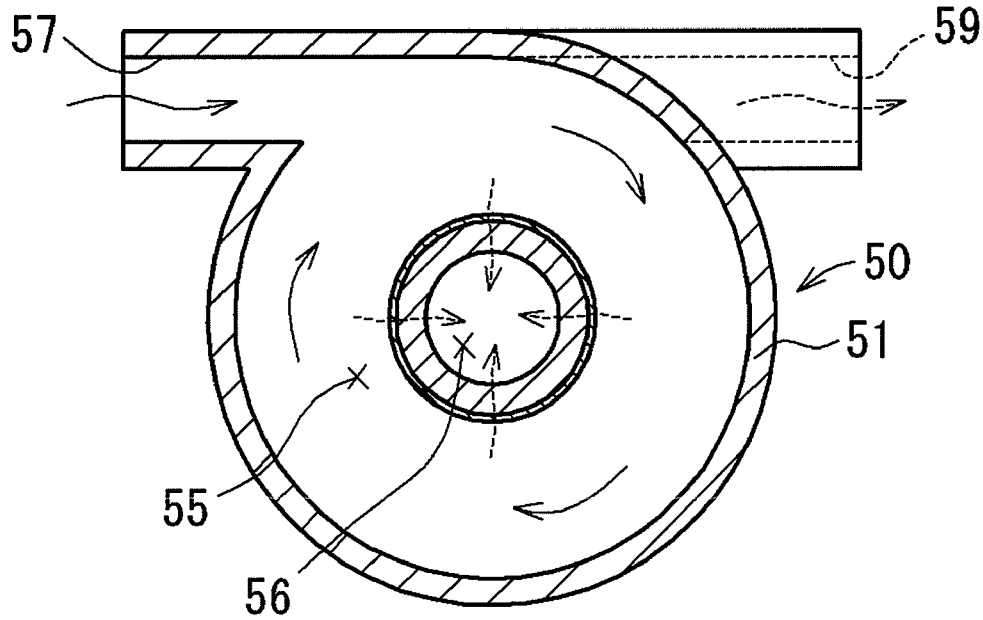
FIG. 5 is a cross-sectional view of the fuel separator taken along a line V-V in FIG. 4.

The fuel separator 10 is mentioned as an example in the present embodiment, the fuel separator 10 having the first region 15 which is the inner side of the ceramic filter 13 and the second region 16 which is the external region of the ceramic filter 13. The present invention is not limited to the same, however, and, as shown in FIG. 4 and FIG. 5, a fuel separator 50 may be used, for example, the fuel separator 50 having a first region 55 which is an external region of a ceramic filter 53 and a second region 56 which is an inner region of the ceramic filter 53. In this case, it is preferable that a separator main body 51 is provided with an oil inlet 57 to introduce lubricating oil in the direction tangential to the separator main body 51. The reason for this is to add a turning force to the oil in the first region 55, and the turn can cause foreign objects such as metal powder having a large relative density in the oil to be collected in the centrifugal direction of the separator main body 51. In addition, it is preferable that the separator main body 51 is provided with an oil discharger 59 to discharge lubricating oil in the direction tangential to the separator main body 51. The reason for this is to add a stronger turning force to the oil in the first region 55.

Figure 6:
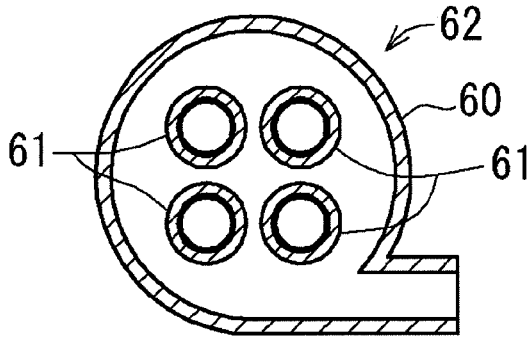
FIG. 6 is a longitudinal sectional view of a fuel separator according to an alternative embodiment.

Although the fuel separator 10 having one ceramic filter 13 in the separator main body 11 thereof is mentioned as an example in the present embodiment, the present invention is not limited to the same, and, as shown FIG. 6, a fuel separator 62 provided with a plurality of ceramic filters 61 (four pieces in the drawing) in a separator main body 60 may be used, for example.

Figure 7:
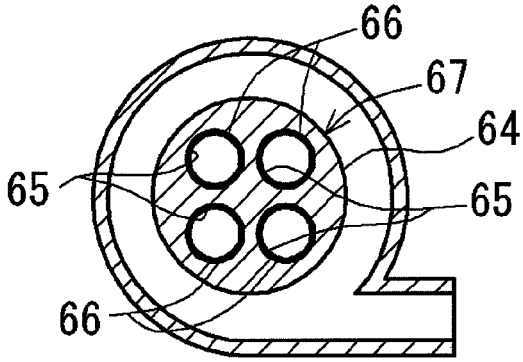
FIG. 7 is a longitudinal sectional view of a ceramic filter according to an alternative embodiment.

Although the ceramic filter 13 in which the separation membrane 13*b* having a cylindrical shape is supported at the inner peripheral side of the support body 13*a* having a cylindrical shape is mentioned as an example in the present embodiment, the present invention is not limited to the same, and, as shown in FIG. 7, a ceramic filter 67 in which a separation membrane 66 is supported in each of plurality of through holes 65 provided in a support body 64 having a columnar shape may be used, for example.

Although the ceramic filter 13 having a tubular shape partitions the interior of the separator main body 11 into the first region 15 and the second region 16 in the present embodiment, the present invention is not limited to the same, and, for example, a planar separation member may be used to partition the interior of the separator main body 11 into the first region and the second region that are adjacent to each other in the right and left direction.

The present invention may widely be utilized as a technology for separating and treating the diluting fuel in the lubricating oil of an internal combustion engine. Particularly, the present invention may suitably be utilized as a technology for separating and treating the diluting fuel in the lubricating oil of a fuel injection engine.

It is noted that the foregoing examples have been provided merely for the purpose of explanation and are in no way to be construed as limiting of the present invention. While the present invention has been described with reference to exemplary embodiments, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular structures, materials and embodiments, the present invention is not intended to be limited to the particulars disclosed herein; rather, the present invention extends to all functionally equivalent structures, methods and uses, such as are within the scope of the appended claims.

The present invention is not limited to the above described embodiments, and various variations and modifications may be possible without departing from the scope of the present invention.

What is claimed is:

1. A diluting fuel-in-oil treating apparatus of an internal combustion engine, the apparatus comprising:

an oil container configured to contain lubricating oil of the internal combustion engine;

an oil path configured to connect the oil container to lubricated parts of the internal combustion engine;

an oil pump provided in the oil path and configured to supply the lubricating oil from the oil container to the lubricated parts of the internal combustion engine;

a bypass path having a first end connected to a downstream side of the oil pump and a second end connected to an upstream side of the oil pump;

a fuel separator provided in the bypass path and configured to separate fuel from the lubricating oil flowing in the bypass path; and an open/close valve provided in the bypass path and configured to open and close the bypass path based on one of a temperature of the lubricating oil and a physical quantity of the lubricating oil that has a correlation with the temperature.

2. The diluting fuel-in-oil treating apparatus of the internal combustion engine according to claim 1, wherein the fuel separator is a cross-flow filtration fuel separator having a separation membrane configured to separate the fuel from the lubricating oil flowing in the bypass path by penetration.

3. The diluting fuel-in-oil treating apparatus of the internal combustion engine according to claim 1, wherein the second end of the bypass path is connected to the oil container.

4. The diluting fuel-in-oil treating apparatus of the internal combustion engine according to claim 2, wherein the cross-flow filtration fuel separator includes a separator main body having a generally tubular shape and a separation member having the separation membrane, wherein the separation member is provided inside the separator main body and partitions the interior of the separator main body into a first region and a second region; and wherein the separator main body includes an oil inlet configured to introduce lubricating oil in the first region, an oil discharger configured to discharge the lubricating oil from the first region, and a fuel discharger configured to discharge the fuel from the second region.

5. The diluting fuel-in-oil treating apparatus of the internal combustion engine according to claim 4, wherein the separation member is generally tubular and has an axis extending along a direction of an axis of the separator main body.

6. The diluting fuel-in-oil treating apparatus of the internal combustion engine according to claim 5, wherein the oil inlet is configured to introduce the lubricating oil in a direction tangential to the separator main body.

7. The diluting fuel-in-oil treating apparatus of the internal combustion engine according to claim 4, wherein the separation member comprises:

the separation membrane, which has a tubular shape and a plurality of fuel-component permeable fine pores; and a support body configured to support the separation membrane and including a plurality of fine pores, wherein the diameters of the plurality of fine pores of the support body are larger than the plurality of fuel-component permeable fine pores of the separation membrane.

* * * * *